US006715999B2

(12) United States Patent
Ancel et al.

(10) Patent No.: US 6,715,999 B2
(45) Date of Patent: Apr. 6, 2004

(54) VARIABLE-CAPACITY SCROLL-TYPE COMPRESSOR

(75) Inventors: Christophe Ancel, Villefranche sur Saone (FR); Yves Rosson, Villars les Dombes (FR); Jean De Bernardi, Lyons (FR)

(73) Assignee: Danfoss Maneurop S.A., Trevoux (FR)

( * ) Notice: Subject to any disclaimer, the term of this patent is extended or adjusted under 35 U.S.C. 154(b) by 0 days.

(21) Appl. No.: 10/251,121

(22) Filed: Sep. 20, 2002

(65) Prior Publication Data

US 2003/0063983 A1 Apr. 3, 2003

(30) Foreign Application Priority Data

Sep. 28, 2001 (FR) ..... 01 12535

(51) Int. Cl.[7] ..... F04B 49/00; F04B 35/00; F04B 17/00; F04B 23/00; F16K 31/22

(52) U.S. Cl. ..... 417/310; 417/299; 417/410.5; 417/440; 417/902; 251/63; 251/43

(58) Field of Search ..... 417/310, 283, 417/299, 410.5, 440, 902; 251/63, 43, 44

(56) References Cited

U.S. PATENT DOCUMENTS 4,253,803 A * 3/1981 Wormmeester et al. ..... 417/283
4,383,805 A * 5/1983 Teegarden et al. ..... 417/308
4,846,633 A 7/1989 Suzuki et al. ..... 417/310
5,074,760 A * 12/1991 Hirooka et al. ..... 417/310
5,240,389 A * 8/1993 Oikawa et al. ..... 417/310
5,803,716 A * 9/1998 Wallis et al. ..... 417/310

FOREIGN PATENT DOCUMENTS

| | | | |
|---|---|---|---|
| EP | 0 681 105 A2 | 11/1995 | ..... F04C/18/02 |
| JP | 7-293456 | 11/1995 | ..... F04C/18/02 |
| JP | 8-303361 | 11/1996 | ..... F04C/18/02 |
| JP | 11-166490 | 6/1999 | ..... F04C/18/02 |

* cited by examiner

*Primary Examiner*—Justine R. Yu
*Assistant Examiner*—Timothy P. Solak
(74) *Attorney, Agent, or Firm*—McCormick, Paulding & Huber LLP

(57) ABSTRACT

In a compressor at least one bypass valve is arranged in a low-pressure zone inside a casing of the compressor. The bypass valve defines a chamber connected by a first duct to at least one compression pocket situated in the peripheral zone of the compression stage and by a second duct to the low-pressure zone, the two ducts opening near one another so that they can be shut off by a shutter which can move in the chamber, being guided by the walls that delimit this chamber, a third duct intended for conveying a shutter-control fluid opening into the lower wall of the chamber of the valve. The shutter is opened by gravity when no control fluid is applied.

9 Claims, 2 Drawing Sheets

VARIABLE-CAPACITY SCROLL-TYPE COMPRESSOR

CROSS-REFERENCE TO RELATED APPLICATIONS

This application is entitled to the benefit of French Patent Application No. 01.12535 filed on Sep. 28, 2001 in the name of Danfoss Maneurop S. A.

FIELD OF THE INVENTION

The subject of the present invention is a variable-capacity scroll-type compressor.

BACKGROUND OF THE INVENTION

Refrigeration compressors allow the high-pressure side of an installation to be supplied with compressed refrigerating gas. In an air-conditioning, refrigerating or heat-pump installation, the compressor may operate cyclically in bursts lasting a few minutes several times per hour. The definition of the duration of the cycle depends on the demand for cold, on the evaporator side, and on the temperature of the external surroundings, on the condenser side. The mass flow rate of gaseous refrigerant needed differs according to these conditions. In particular, the displacement of the compressor needs to be tailored to the conditions conventionally defining the installation. To this end, it is possible to use set-ups with several compressors, which makes it possible to match the demand by selecting how many compressors need to operate.

Another solution is to use just one compressor with a power-modulating device. This power-modulation can be obtained in various ways:

- changing the speed of the compressor shaft (variable speed),
- having a restriction on the suction side of the compressor (variable inlet pressure),
- recirculating some of the refrigerant (variable displacement or capacity).

In one type of scroll-type compressor, the compressor is delimited by a sealed casing, this casing comprising a gas inlet compartment which is at the low pressure side and which supplies the compression stage which consists of two scroll elements, a fixed element and a moving element, the moving element being driven by a motor with an orbital motion. The gas is let into pockets delimited by the two scroll elements arranged at the periphery, the volume of the peripheral pockets being greater than that of the central pockets. Thus, during the orbital motion of the moving element, the pockets delimited by the two, fixed and moving, elements decrease the volume from the outside inwards, causing the gas to be compressed until it reaches the centre of the compression stage which has a delivery orifice and/or a duct equipped with a non-return shutter connected to the high-pressure zone of the compressor. The invention is aimed at a compressor in which the displacement or capacity is variable.

Document U.S. Pat. No. 4,846,633 describes a variable-capacity scroll-type compressor in which the fixed scroll element is equipped with a bypass device able to place each peripheral pocket, into which gas is admitted, in communication with a low-pressure volume. For this purpose, each bypass device comprises a chamber formed in the fixed scroll element, comprising an orifice in communication with a pocket of the compression stage of the compressor and in communication with a low-pressure chamber of the compressor. The corresponding two orifices may be shut off and/or opened simultaneously using one and the same shutter. This shutter is subjected on its opposite side to the pressure of a control fluid intended to keep the shutter pressed against its seat, that is to say isolating the pocket in question from the compression stage and the pressure chamber when the maximum compressor capacity is to be used. When the working capacity of the compressor is to be reduced, the pressure acting on the shutter is reduced so that the shutter lifts and places the pocket in question of the high-pressure stage in communication with the low-pressure chamber. To make this movement possible, a spring is associated with the shutter and acts in a direction to open the latter, because the opening motion needs some impetus and the phenomena of flutter needs to be avoided.

Such an arrangement is technically more difficult to envisage in the case of a scroll-type compressor in which the fixed scroll element partly delimits the high-pressure zone of the compressor, in as much as the tubes conveying the control fluid pass through the casing of the high-pressure enclosure.

The present invention is aimed specifically at a scroll-type compressor of the latter type.

SUMMARY OF THE INVENTION

The purpose of the invention is to provide such a variable-capacity scroll-type compressor in which the variation in capacity is obtained using means which are simple and reliable without entailing the machining of the chambers of the bypass device in the fixed scroll element and in which the parts used are easy to machine and can be tailored to suit various designs of bypass circuits.

To this end, the scroll-type compressor to which the invention relates, of the type comprising a fixed scroll element and a moving scroll element which are arranged inside a hermetic casing. The moving element is driven by a motor with an orbital motion so as to delimit, with the fixed element, pairs of compression pockets the volume of which decreases towards the centre of the elements during the orbital motion. The compressor has at least one intake chamber arranged in the low-pressure zone inside the casing intended to supply the compression pockets with fluid and a central outlet passage for the fluid compressed by the pockets. The central outlet passage is equipped with a non-return shutter and supplies a high-pressure chamber delimited in part by the fixed scroll element, is characterized in that it comprises at least one bypass valve arranged in the low-pressure zone inside the casing of the compressor, comprising a chamber connected by a first duct to at least one compression pocket and by a second duct to the low-pressure zone, the two ducts opening near one another so that they can be shut off by a shutter which can move freely in the chamber, being guided by the walls that delimit this chamber, a third duct intended for conveying a shutter-control fluid opening into the lower wall of the chamber of the valve, and the bypass valve is delimited by a special-purpose body housed in the enclosure delimited by the compressor casing.

This device makes it possible to switch from a nominal mode of operation with 100% of the flow rate, to a reduced-capacity mode, for example with a 40% reduction in flow rate. To switch from the nominal mode of operation to a reduced-capacity mode, it is necessary to open the valve associated with each pocket which can be emptied, this pocket being placed in communication via the valve with a low-pressure zone of the compressor. It is to be noted that the shutter associated with the bypass valve is subject to the action of gravity, which means that as soon as the pressure of the control fluid decreases, the shutter switches to its open position without the need to use a spring. Furthermore, given the way that the shutter opens under the effect of gravity there is no phenomenon of flutter thereof. It should be noted that on compressor start-up, the shutter is open, because the installation supplies no high-pressure fluid to the bypass valve, and this reduces the motor start-up torque.

According to one embodiment of the invention, the first duct and the second duct open vertically, being directed downwards in one and the same plane and forming a seat for the shutter, this shutter being more or less flat, for example in the form of a disc.

According to one feature of the invention, the second duct placing the valve in communication with the low-pressure zone comprises an annular groove formed in the wall of the chamber forming a seat for the shutter opening into at least one opening parallel to the axis of the valve and communicating with the low-pressure zone, while the first duct, connected to at least one compression pocket, opens to the centre of the seat. The cross section of the annular groove is defined according to the desired area of bearing between the shutter and its seat, so as to achieve the desired level of sealing and the desired speed.

Advantageously, the bypass valve comprises several openings placing the annular groove in communication with the low-pressure zone.

According to another feature of the invention, the underside of the chamber of the valve, forming a stop for the shutter, and into which the duct conveying the control fluid opens, comprises a central opening into which this duct opens, together with a peripheral channel concentric with this opening. This peripheral channel makes it possible to avoid the shutter becoming stuck against its stop by oil.

According to another feature of the invention, the third duct conveying the control fluid passes through the compressor casing and is supplied from a source of fluid situated outside the compressor. The valve can be controlled on the basis of the pressure in the condenser or on the basis of the low pressure in the evaporator.

According to one embodiment of this compressor, the first duct placing the bypass valve in communication with at least one compression pocket consists in part of vertical and horizontal bores made in the fixed scroll element.

It should be noted that if the fixed scroll part is a casting, then it is possible to form ducts therein by employing a casting method using polystyrene inserts.

According to another embodiment of this compressor, the first duct placing the bypass valve in communication with at least one compression pocket comprises one or two passages formed in the fixed scroll element, opening into a tube arranged in the high-pressure zone of the compressor and extending into the compressor as far as the bypass valve.

Furthermore, the chamber containing the shutter has a calibrated leakage dropping the pressure in the compartment containing the control fluid when the supply of control fluid ceases. This leakage may consist of a calibrated orifice made in the valve body or obtained by clearance between the various assembled parts of which the valve is formed.

BRIEF DESCRIPTION OF THE DRAWINGS

The invention will be clearly understood with the aid of the description which follows, with reference to the drawings which, by way of nonlimiting examples depicts one embodiment of the invention.

DETAILED DESCRIPTION OF THE PREFERRED EMBODIMENTS

Figure 1:
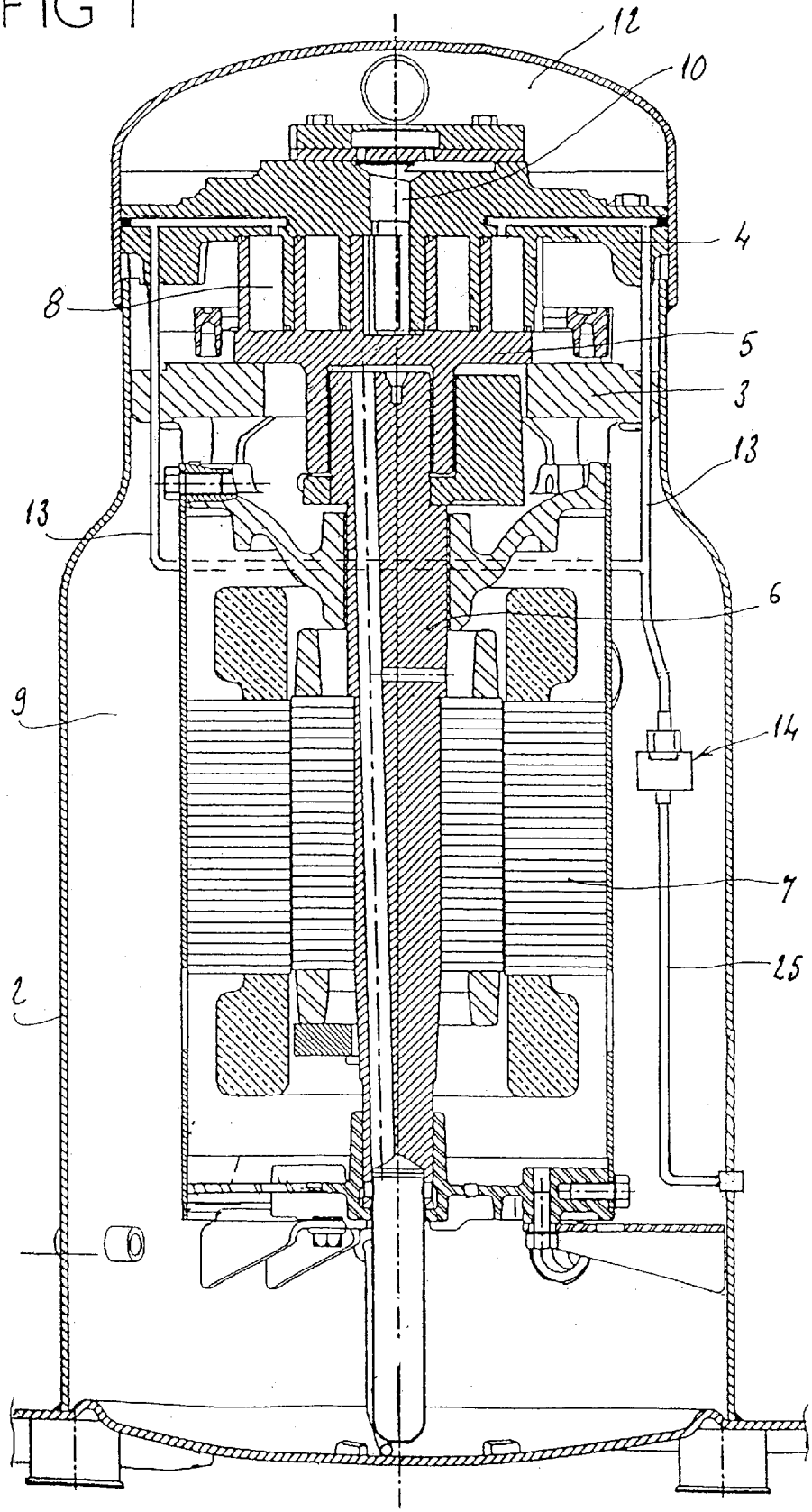
FIG. 1 is a view in longitudinal section of a compressor equipped with a bypass valve housed between the outer casing and the motor.
Figure 2:
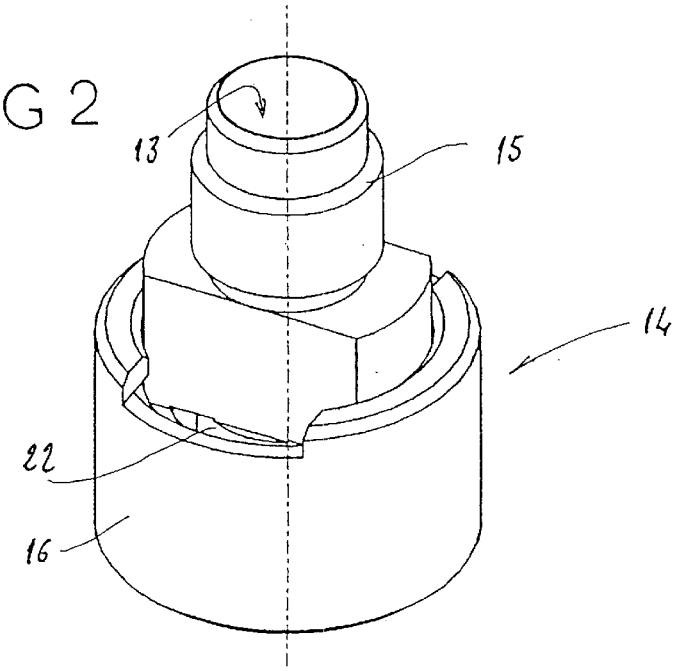
FIG. 2 is a perspective view of the bypass valve.

The compressor depicted in FIG. 1 comprises a hermetic outer casing 2 inside which is mounted a body 3 supporting a compression stage possessing a fixed scroll element 4 and a moving scroll element 5. The moving scroll element 5 is driven by a shaft 6 off a motor 7 with an orbital motion, so as to delimit, with the fixed element 4, compression pockets 8 the volume of which decreases towards the centre of the elements 4, 5 during the orbital motion. The pockets are filled, generally symmetrically and in pairs, from an intake chamber situated in the low-pressure zone 9 of the compressor. The compressed gas leaves via an outlet duct 10 towards a high-pressure chamber 12, through a shutter valve not depicted in the drawing.

Figure 3:
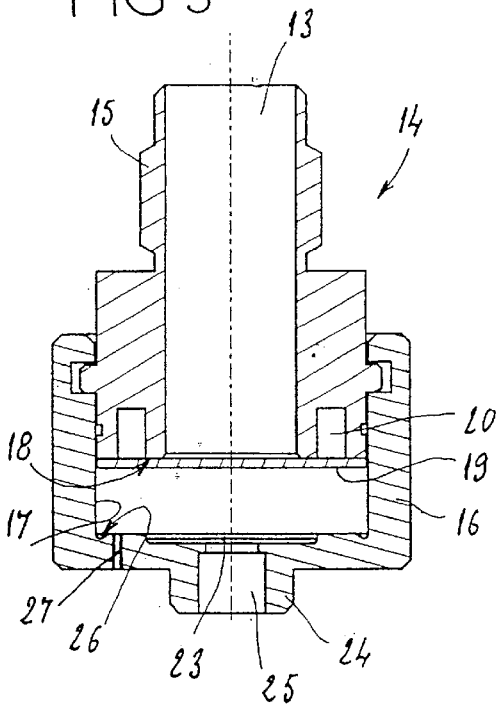
FIGS. 3 and 4 are two views in longitudinal section in the closed position and in the open position, respectively.
Figure 4:
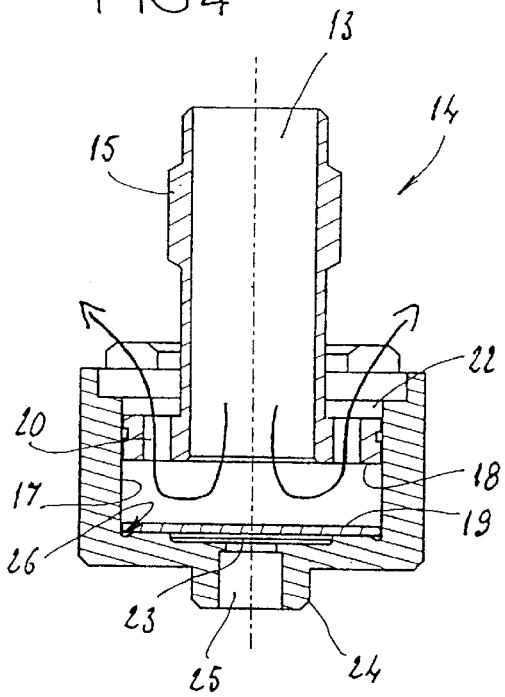

As the purpose of the present invention is to tailor the capacity of the compressor to suit the power that is to be delivered, by varying the working volume of the pockets, two symmetric pockets 8 are each connected by a duct 13 to a bypass valve 14. The two ducts 13 converge into a single duct connected to the valve 14 by a vertical connector 15 directed downwards. The bypass valve 14, which is situated in the low-pressure zone of the compressor, comprises a body 16 in which there is formed a cylindrical chamber 17 which has, at the top, a surface 18 forming the seat for a shutter 19, depicted in the position of closure of the duct connected to the pockets 8 in FIG. 3. Formed in the seat 18 is an annular groove 20 which is opened to the outside, that is to say into the low-pressure zone of the compressor via two openings 22. Opening into the lower wall of the chamber 17 is an opening 23, supplied by a connector 24 with control fluid conveyed by a pipeline 25 passing through the outer casing 2 of the compressor. The opening 23 is dimensioned in such a way that the area of contact of the shutter 19 with the underside of the chamber 17 is reduced, particularly so that the shutter 19 rests on this underside only at its periphery. This limited area of contact makes it possible to avoid any impact of the shutter 19 against its seat 18 as the result of a delayed start of movement resulting from the shutter 19 becoming stuck to the valve body 16 if any oil which may seep through is present. When the full capacity of the compressor has to be used, the control fluid presses the shutter 19 against the seat situated at the top, as shown in FIG. 3. When the capacity of the compressor is to be reduced, the pressure of the control fluid is returned to the low-pressure value so that the shutter moves from its position depicted in FIG. 3 into the position depicted in FIG. 4 thus allowing the fluid contained in the pockets 8 to pass through the pipelines 13 and the connector 15 to the annular groove 20 and the openings 22 to the low-pressure zone.

A calibrated orifice 27 is formed in the body 16 of the valve, and allows control fluid contained in the chamber to escape so as to allow the shutter to change position when control fluid ceases to be supplied.

As is evident from the foregoing, the invention affords a great improvement to the state of the art by supplying a variable-capacity compressor of simple and reliable structure.

The invention is not restricted simply to the embodiment of this compressor which has been described hereinabove by way of example; on the contrary, it encompasses all alternative forms thereof. Thus, in particular, the ducts may consist of tubes circulating above the fixed scroll element in the high-pressure chamber; the holes 22 may open laterally with respect to the valve body 16; the shutter 19 may, in this case, have the form of a disc and be pressed against the seat 18, as described above, or may have a thickness which gives it a cylindrical shape allowing it, in the closed position, to close off these laterally-opening holes 22; the compressor may have two bypass valves, controlled simultaneously or otherwise.

What is claimed is:

1. A variable-capacity scroll-type compressor comprising:

a hermetic casing;

a fixed scroll element and a moving scroll element positioned in the hermetic casing;

a motor coupled to, and for driving the moving scroll element in an orbital motion;

the moving scroll element and the fixed scroll element coacting to form pairs of compression pockets, each defining a volume that decreases towards a center defined by the moving and fixed scroll elements during the orbital motion;

the hermetic casing having, at least one intake chamber located in a low pressure zone for supplying the compression pockets with fluid;

a central outlet passage for receiving fluid compressed in the compression pockets;

a non-return shutter positioned in the central outlet passage, the central outlet passage supplying fluid to a high pressure chamber formed in part by the fixed scroll element;

at least one by-pass valve positioned in the low pressure zone, said bypass valve defining a chamber in fluid communication via a first duct with at least one of the compression pockets, said chamber also being in communication with the low pressure zone via a second duct;

the first and second ducts each having an opening proximate the other so that the openings can be closed via a shutter movably positioned in the chamber;

a third duct opening into the chamber for conveying a shutter control fluid; and wherein the bypass valve defines a body located in the hermetic casing.

2. A compressor according to claim 1, wherein the first duct and the second duct open vertically, being directed downwards in one and the same plane and forming a seat for the shutter, the shutter being approximately flat.

3. A compressor according to claim 1, wherein the second duct includes an annular groove formed in a wall that defines the chamber forming a seat for the shutter and opening into at least one opening approximately parallel to a axis of the valve and communicating with the low-pressure zone, while the first duct, opens to the centre of the seat.

4. A compressor according to claim 3, further comprising a plurality of openings placing the annular groove in fluid communication with the low-pressure zone.

5. A compressor according to claim 1, wherein a bottom of the chamber of the valve, forming a stop for the shutter, and into which the third duct conveying the control fluid opens, comprises a central opening, dimensioned in such a way that an area of contact of the shutter with the bottom of the chamber is small, particularly so that the shutter rests on this underside only at its periphery.

6. A compressor according to claim 1, wherein the third duct conveying the control fluid passes through the hermetic casing and is supplied from a source of fluid situated outside the compressor.

7. A compressor according to claim 1, wherein the first duct is formed in part by vertical and horizontal bores defined by the fixed scroll element.

8. A compressor according to claim 1, wherein the first duct placing the bypass valve in communication with at least one compression pocket defines at least one passage formed in the fixed scroll element, opening into a tube arranged in the high-pressure zone of the compressor and extending into the compressor as far as the bypass valve.

9. A compressor according to claim 1, wherein the chamber containing the shutter has a calibrated leakage dropping the pressure in a compartment containing the control fluid when the supply of control fluid ceases.

* * * * *